US005456626A

United States Patent [19]

Ming-Kang

[11] Patent Number: 5,456,626

[45] Date of Patent: Oct. 10, 1995

[54] DUALLY-OPERATED ODOR AND SOUND GENERATING MEANS

[76] Inventor: Liao Ming-Kang, c/o Hung Hsing Patent Service P.O. Box 55-1670, Taipei, Taiwan

[21] Appl. No.: 303,571

[22] Filed: Sep. 8, 1994

[51] Int. Cl.[6] ..... A63H 3/00

[52] U.S. Cl. ..... 446/397; 446/475; 446/297; 222/78; 222/160; 222/39

[58] Field of Search ..... 446/72, 73, 74, 446/297, 305, 397, 400, 475; 222/160, 78, 39; 239/72, 211

[56] References Cited

U.S. PATENT DOCUMENTS

| | | | |
|---|---|---|---|
| 3,168,983 | 2/1965 | Bosak | 222/78 |
| 4,118,691 | 10/1978 | Sims . | |
| 4,570,824 | 2/1986 | Bolling | 222/39 |
| 4,591,071 | 5/1986 | Johnson | 222/39 |
| 4,757,946 | 7/1988 | Johnson | 222/211 |
| 4,944,704 | 7/1990 | Grace | 446/74 |
| 4,991,755 | 2/1991 | Grusmark | 222/39 |
| 5,213,234 | 5/1993 | Stenfanopoulos | 222/78 |
| 5,254,028 | 10/1993 | Liao | 446/297 |
| 5,358,144 | 10/1994 | Mock | 222/78 |

*Primary Examiner*—Robert A. Hafer
*Assistant Examiner*—Michael O'Neill

[57] ABSTRACT

A odor and sound generating device includes an odor distributing device and a sound generating device mounted in a housing, and a manual depression member resiliently mounted on the housing and operatively depressing both the odor distributing device and the sound generating device simultaneously, whereby upon a manual depression of the depression member, both odor distributing device and sound generating device may be depressed to emit odor and to produce sound or music simultaneously.

3 Claims, 4 Drawing Sheets

DUALLY-OPERATED ODOR AND SOUND GENERATING MEANS

BACKGROUND OF THE INVENTION

A fluid releasing and sound generating toy of U.S. Pat. No. 5,254,028 granted to the same inventor of this application includes a toy body, a container, an electric valve, a tube, a sound generating unit, a receiving circuit and a controller unit, whereby upon actuation of the controller unit, an electrical signal will be received by the receiving circuit to activate the electric valve to release the compressed fluid from the container, and to activate the sound generating unit for sound generation simultaneously.

Since an electric valve should be provided on the container to be actuated by the control unit through the receiving circuit. The electric valve may be, for instance, a solenoid valve or the other electrically operated or controlled valve, still requiring a complex mechanical and electrical mechanism and thereby increasing the production cost thereof.

SUMMARY OF THE INVENTION

The object of the present invention is to provide a dually-operated odor and sound generator including an odor distributing device and a sound generating device mounted in a housing, and a manual depression member resiliently mounted on the housing and operatively depressing the odor distributing device and the sound generating device simultaneously, whereby upon a manual depression of the depression member, both odor distributing device and sound generating device may be depressed to emit odor and to produce sound or music simultaneously.

DETAILED DESCRIPTION

Figure 1:
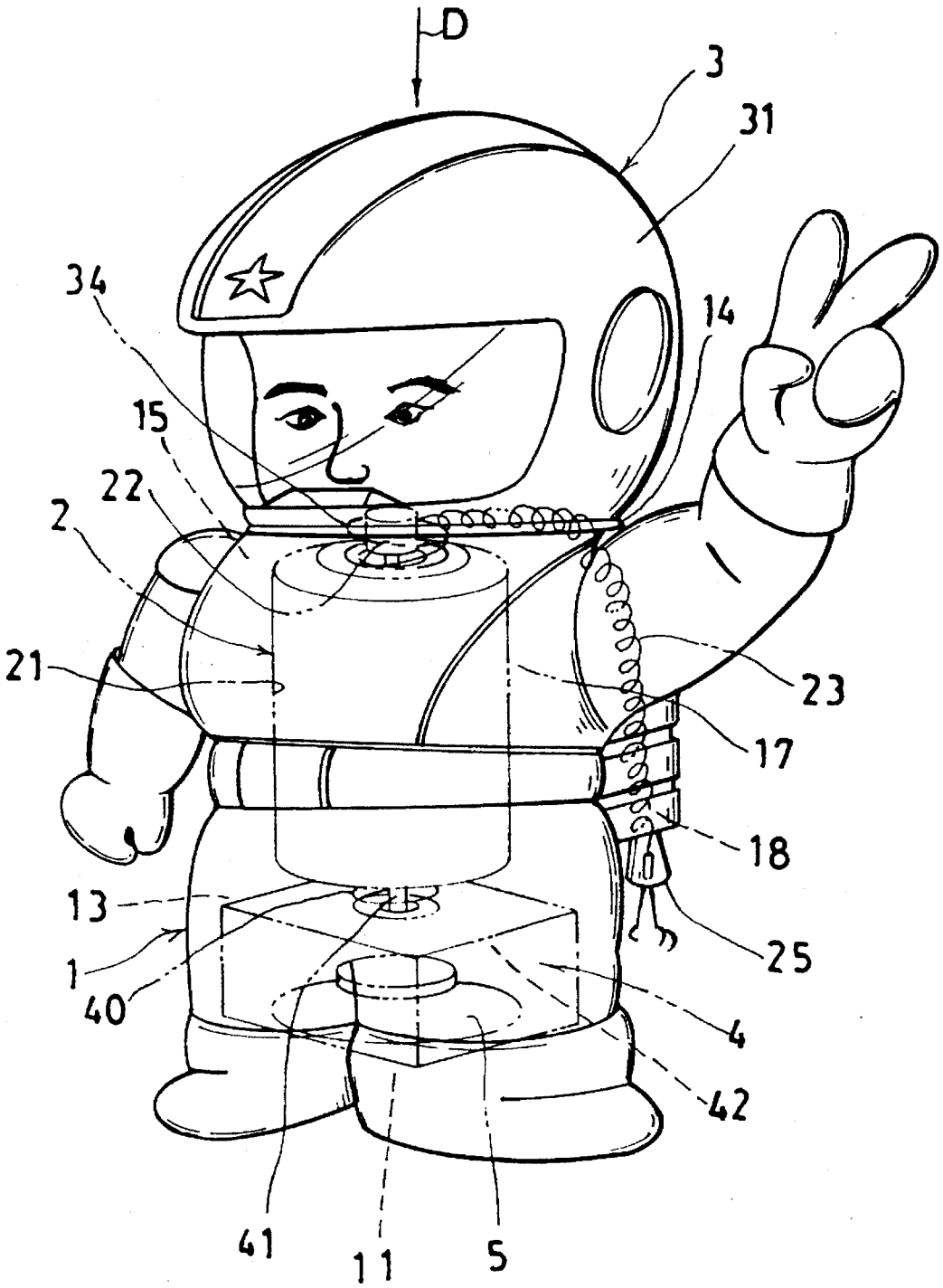
FIG. 1 is a perspective view of the present invention.
Figure 2:
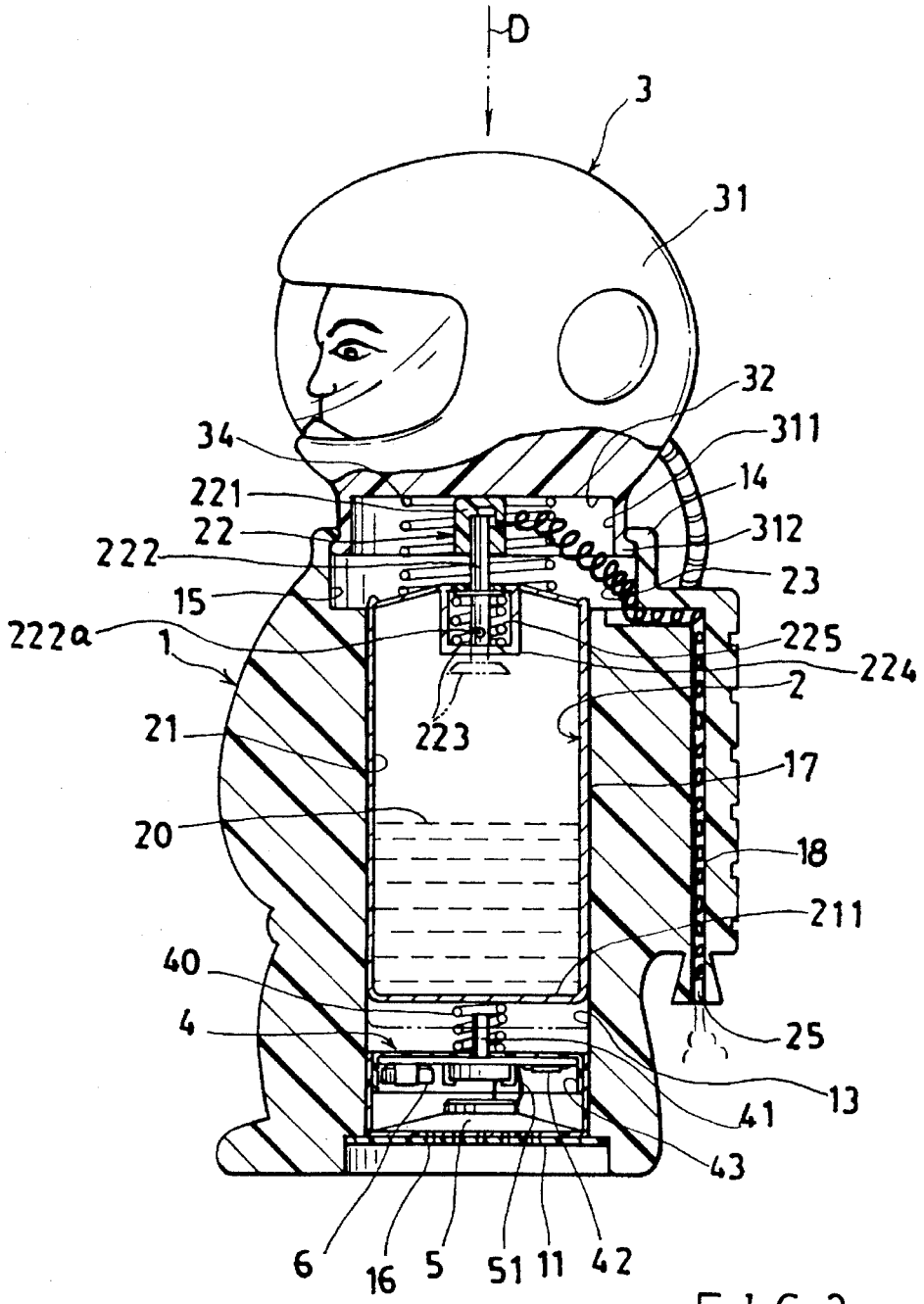
FIG. 2 is a longitudinal sectional drawing of the present invention as shown in FIG. 1.

As shown in FIGS. 1 and 2, the present invention comprises: a housing 1, an odor distributing means 2, a manual actuator 3, and a sound generating and control means 4 having a buzzer or speaker 5 and power source 6 electrically connected to the sound generating and control means 4.

Figure 3:
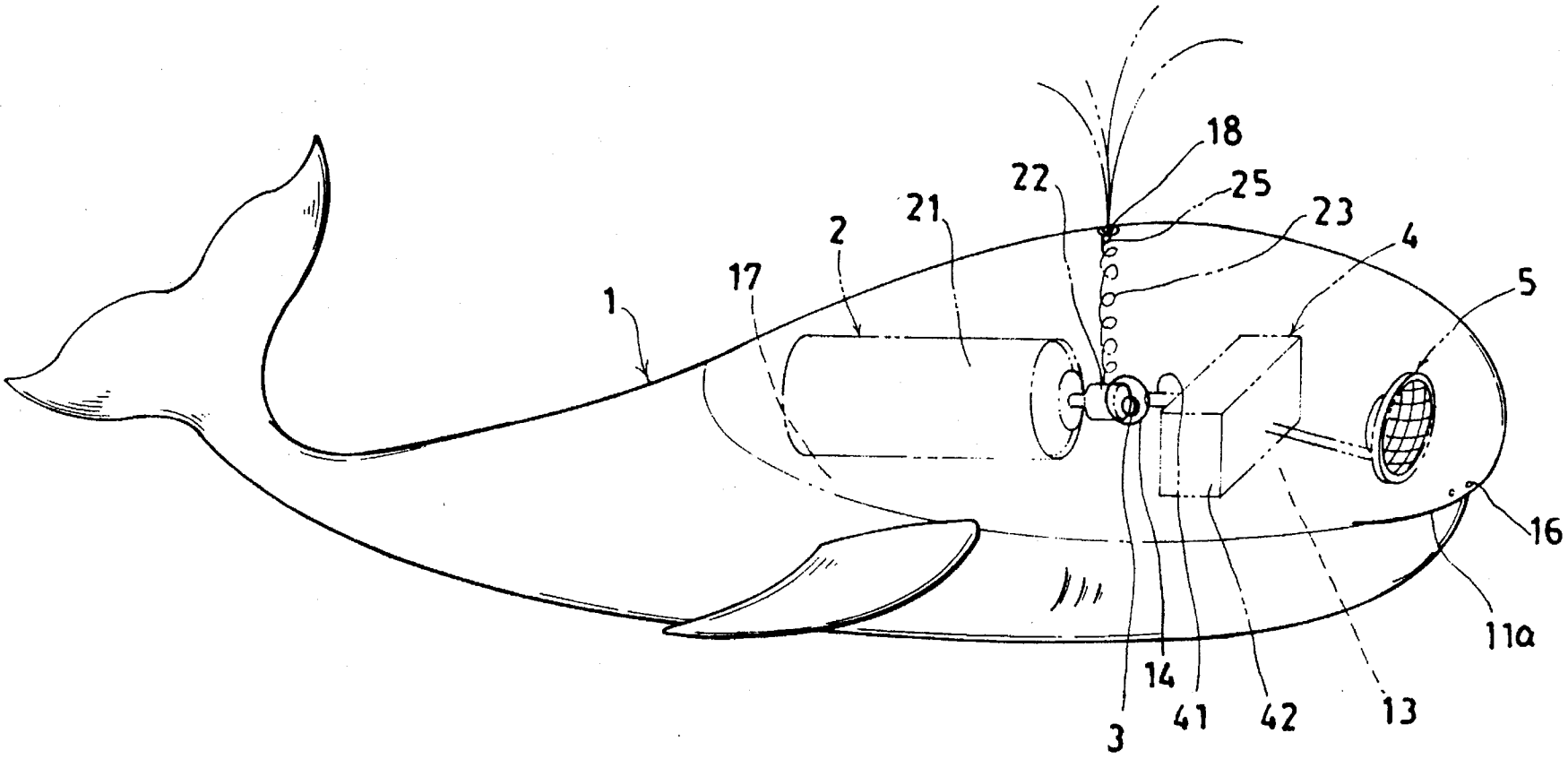
FIG. 3 is a perspective view of another preferred embodiment of the present invention.

The housing 1 and the manual actuator 3 of the present invention may be made to be a toy, a decorative device, a doll, a flower, tree and any other articles capable of producing sound and odor simultaneously. The embodiment as shown in FIG. 1 is made to imitate an astronaut, while the other preferred embodiment as shown in FIG. 3 is modified to mimic an animal such as a whale, being not limited in this invention. The odor produced from the odor distributing means 2 is also not limited, which may be fragrant, perfuming or may even be stinking, pungent odors. The sound produced by the sound generating and control means 4 may be music, any sound or even voices, not limited in this invention.

As shown in FIGS. 1 and 2, the housing 1 of the present invention includes: a base plate 11, a first or lower chamber 13 formed in the housing 1 for securing the sound generating and control means 4, the buzzer 5 and the power source 6 which may be battery or batteries in the first or lower chamber 13, a second or upper chamber 17 formed in the housing 1 for securing the odor distributing means 2 in the second or upper chamber 17, a reciprocating socket 15 recessed in the housing 1 from an opening rim 14 circumferentially formed around an opening formed in the housing 1 for reciprocatively holding a depressing member 31 of the manual actuator 3 in the reciprocating socket 15, a plurality of perforations 16 formed or drilled in the housing 1 such as being drilled in the base plate 11 having the buzzer 5 secured thereon, and a delivery passage 18 formed through the housing 1 for passing a flexible tube 23 of the odor distributing means 2 in the delivery passage 18.

The odor distributing means 2 includes: a container 21 filled with compressed fluid 20 which may be released to be gas or vapor when opening a releasing valve 22 of the container 21 under normal atmospheric pressure to emit odor or smell, a releasing valve 22 which may be an aerosol releasing valve or any other valves openable by depressing downwardly or inwardly a stem of the valve 22, a tube or a flexible tube 23 connected to the container 21 through the releasing valve 22, and a nozzle 25 formed at an outermost end of the tube 23, and positioned at an opening end of the delivery passage 18 in the housing 1.

If the housing 1 is made to imitate an astronaut's body including an upper torso and a lower torso, the delivery passage 18 may be formed through a backpack of the astronaut while a nozzle 25 of the odor distributing means 2 may be formed at the simulated thrust nozzle on a lower portion of the astronaut's backpack.

The manual actuator 3 includes: a depressing member 31 telescopically connectable with and protruding outwardly from the housing 1 such as imitating a head or helmet of an astronaut, a thrusting portion 32 formed on an inner portion of the depressing member 31 depressible on the releasing valve 22 for opening the valve 22 of the odor distributing means 2 and also depressible on a push button 41 of the sound generating and control means 4 for actuating the sound generating and control means 4 for the sounding of the buzzer 5, and an actuator restoring spring 34 retained on the container 21 of the odor distributing means 2 or in the housing 1 for normally urging the depressing member 31 outwardly or upwardly from the housing 1 ready for a next depression thereon.

As shown in FIG. 2, the depressing member 31 may include a neck portion 311 generally cylindrical shaped reciprocatively or telescopically engageable with the reciprocating socket 15 recessed in an upper portion of the housing 1, and a flange 312 circumferentially formed on a lowest perimeter of the neck portion 311 to be limited by the opening rim 14 of the housing 1.

When depressing (D) the depressing member 31 imitating an astronaut's head or helmet, the thrusting portion 32 of the manual actuator 3 will depress the releasing valve 22 to open the valve 22 for releasing the compressed fluid 20 outwardly through the tube 23 to be sprayed through the nozzle 25 to imitate an ejection of combustion waste gas from a rocket engine of an astronaut's backpack for playing or decorative interest; and simultaneously a container bottom 211 of the container 21 will depress the push button 41 for sounding the buzzer 5 for producing music or sound for interest, The sound generating and control means 4 includes: the push button 41 resiliently held in a box 43 and normally protruding outwardly by a button restoring spring 40 retained on the box 43 to contact the container 21 which is positioned below the thrusting portion 32 of the manual actuator 3 ready for a depression by the manual actuator 3, and a control circuit 42 electrically connected between the push button 41, the buzzer (or speaker) 5 and the power source 6 which may be a battery or plural batteries connected in series and stored in the box 43 for producing sound (music, voice or any other kinds of sound) from the buzzer 5 in a pre-determined time period.

The buzzer 5 may be secured on a bottom portion of the housing 1 as shown in FIG. 2 or in any other locations of the housing 1. As shown in FIG. 2, the push button 41 of the sound generating and control means 4 may be protruded upwardly from the box 43 retained in a lower portion of the housing 1 to be operatively depressed by the container 21 of the odor distributing means 2 when downwardly depressing the depressing member 31 and the releasing valve 22 for actuating the sound generating and control means 4 for the sounding of the buzzer 5. The button restoring spring 40 as shown in FIG. 2 normally urges the container bottom 211 upwardly to separate a forcible depression of the container 21 on the push button 41 for disconnecting the electrical connection between the push button 41 and the control circuit 42 without producing sound through the buzzer 5 when the sounding and odor is not required.

The releasing valve 22 may be any conventional valve of an aerosol having a cartridge filled with compressed fluid, and may include: a cap member 221 mounted on an outer end of a hollow valve stem 222 connectable with the flexible tube 23, a plug 223 normally sealably rested on a valve seat 224 formed in the container 21 and openable when depressing the manual actuator 3 to depress the cap member 221 and the stem 222 downwardly to allow a fluid port 222a opened at a lower end of the stem 222 to communicate with the interior of the container 21 for releasing gas or vapor from the compressed fluid 20 outwardly through the fluid port 222a, the hollow stem 222, the tube 23, and the nozzle 25 of the odor distributing means 2, and a valve restoring spring 225 normally urging the stem 222 and plug 223 outwardly or upwardly for sealing the plug 223 on the seat 224 for closing the valve 22. Other modifications of the odor (fluid) distributing systems may be made in accordance with the present invention.

Whenever depressing the manual actuator 3 of the present invention as shown in FIG. 2, all the elements of the thrusting portion 32, the cap member 221, the stem 222, the spring 225, the container 21 and the spring 34 will also be simultaneously forced downwardly or inwardly to pressurize the container 21 to allow its bottom 211 to depress the push button 41 for simultaneously actuating the sounding of the buzzer 5 by the operation of the sound generating and control means 4.

Figure 4:
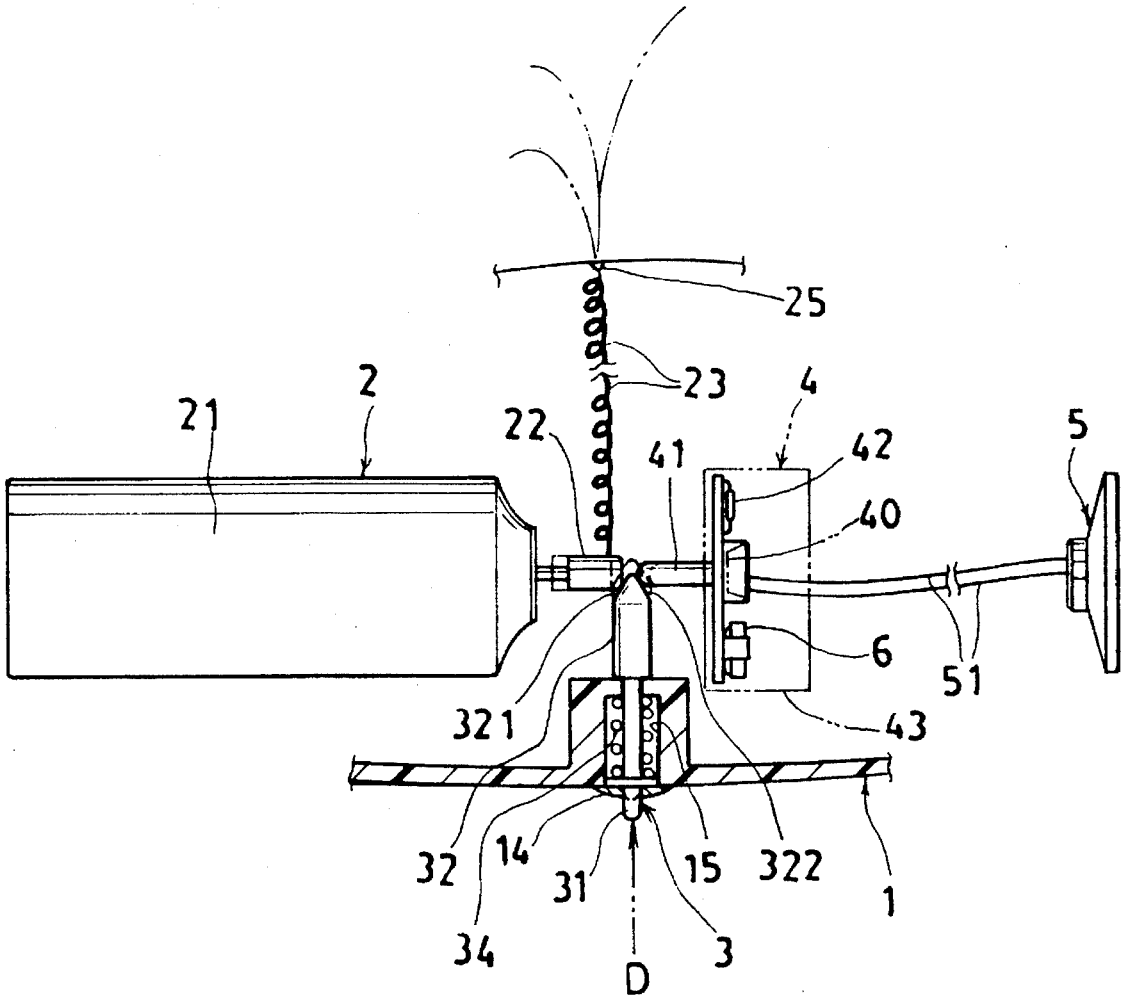
FIG. 4 is an illustration showing a depressing for actuating both an odor distributing means and a sound generating and control means of the present invention as shown in FIG. 3.

As shown in FIGS. 3 and 4, the housing 1 has been modified to be a whale animal, and the manual actuator 3 is formed on an eye of the whale (housing 1). The container 21 of the odor distributing means 2 and the sound generating and control means 4 may be secured in the chambers 17, 13 inside the whale-shaped housing 1.

The buzzer 5 may be installed in a front portion 11a of the housing 1 having the perforations 16 formed therein for transmitting sound from the buzzer 5 outwardly. The buzzer 5 is electrically connected to the control circuit 42 and power source of battery 6 by electric wires 51. The nozzle 25 may be secured at a top opening 18 of the housing to imitate a blowhole of a whale.

As shown in FIG. 4, the releasing valve 22 of the odor distributing means 2 and the push button 41 of the sound generating and control means 4 may be facing or approximated with each other and generally aligned to be synchronously depressed by a first sloping surface 321 and a second sloping surface 322 of a wedge shaped thrusting portion 32 formed on an inner end portion of the depressing member 31 with the first and second sloping surfaces 321, 322 tapered inwardly towards the releasing valve 22 and the push button 41, whereby upon an inwardly depressing of the push button 41 to inwardly move the thrusting portion 32 to allow the two sloping surfaces 321, 322 to laterally thrust the releasing valve 22 and the push button 41 for opening the valve 22 for emitting odor and actuating the push button 41 for sounding the buzzer 5.

The depressing member 31 is protruded outwardly from the thrusting portion 32 and normally urged outwardly by an actuator restoring spring 34 retained in a reciprocating socket 15 recessed in the housing 1 having an opening rim 14 shielding the socket 15 for limiting the spring 34 within the socket 15.

Figure 2A:
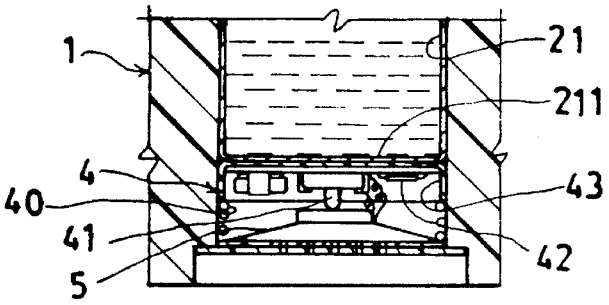
FIG. 2A shows another relationship between the container and the push button of the present invention.

Many other shapes, structures and designs may be made in accordance with the present invention for making the elements of the odor and sound generating devices of this invention to imitate an animal, a doll, a toy, or any other decorative or ornamental articles or devices, not limited in this invention. The push button 41 may be inverted as shown in FIG. 2A to be resiliently retained between the container 21 and the buzzer 25 and is only actuated when downwardly depressing the valve 22 and the container 21 for sounding the buzzer 5.

I claim:

1. An odor and sound generating means comprising: a housing;

an odor distributing means including a container filled therein with compressed fluid capable of producing odor and secured in said housing, a tube connected to said container through a releasing valve formed on said container, and a nozzle formed at an outer end of said tube and positioned at an opening formed in said housing;

a manual actuator resiliently telescopically mounted on said housing;

a sound generating and control means secured in said housing and electrically connected with a buzzer and a power source mounted in said housing, having a push button normally protruded outwardly from said sound generating and control means;

said odor distributing means secured in a first chamber in said housing; said sound generating and control means connected with said buzzer secured in a second chamber in said housing; and said manual actuator telescopically mounted on said housing including depressing member protruding outwardly from the housing as urged by an actuator restoring spring retained in said housing, and a thrusting portion secured to an inner end portion of said depressing member, whereby upon an inwardly depressing of the depressing member of the manual actuator, said releasing valve and said push button will be simultaneously actuated to emit odor outwardly through said tube and said nozzle by opening said valve of said odor distributing means and to produce sound from said buzzer simultaneously as controlled by a control circuit of said sound generating and control means; and said odor distributing means including: said Container secured in an upper portion in said housing, said releasing valve resiliently mounted on an upper portion of said container and protruding upwardly to normally contact said thrusting portion of said manual actuator telescopically mounted on an upper portion of said housing, and said tube passing through a delivery passage in said housing; said sound generating and control means including said push button positioned below said container to be depressed by said container when downwardly depressing said manual actuator and said releasing valve to lower said container to force said push button downwardly, and a button restoring spring retained between a container bottom of said container and said sound generating and control means for normally urging said container upwardly to release a downwardly depressing of said container on said push button for disconnecting an electrical connection between said push button, said control circuit and said buzzer secured on a bottom portion in said housing when a sounding of the buzzer and emitting of odor from the container is not required.

2. An odor and sound generating means comprising:

a housing;

an odor distributing means including a container filled therein with compressed fluid capable of producing odor and secured in said housing, a tube connected to said container through a releasing valve formed on said container, and a nozzle formed at an outer end of said tube and positioned at an opening formed in said housing;

a manual actuator resiliently telescopically mounted on said housing;

a sound generating and control means secured in said housing and electrically connected with a buzzer and a power source mounted in said housing, having a push button normally protruded outwardly from said sound generating and control means;

said odor distributing means secured in a first chamber in said housing; said sound generating and control means connected with said buzzer secured in a second chamber in said housing; and said manual actuator telescopically mounted on said housing including a depressing member protruding outwardly from the housing as urged by an actuator restoring spring retained in said housing; and said manual actuator including a thrusting portion secured on an inner end portion of said depressing member and generally wedge shaped to have a first sloping surface and a second sloping surface tapered inwardly from said thrusting portion, whereby upon an inwardly depressing of the depressing member of the manual actuator, said first sloping surface of said thrusting portion will thrust said releasing valve of said odor distributing means for opening said valve for releasing said compressed fluid for emitting odor, and said second sloping surface of said thrusting portion will simultaneously thrust said push button of said sound generating and control means for producing sound of said buzzer as controlled by said sound generating and control means

3. An odor and sound generating means according to claim 2, wherein said releasing valve and said push button normally protrude from said odor distributing means and said sound generating and control means towards said two sloping surfaces of said thrusting portion of said manual actuator to normally contact said two sloping surfaces ready for a depression by said thrusting portion of said manual actuator.

* * * * *